US010513140B2

(12) United States Patent
Awano et al.

(10) Patent No.: US 10,513,140 B2
(45) Date of Patent: Dec. 24, 2019

(54) BINDING DEVICE AND IMAGE PROCESSING APPARATUS

(71) Applicant: FUJI XEROX CO., LTD., Tokyo (JP)

(72) Inventors: Hiroaki Awano, Yokohama (JP); Yutaka Nobe, Yokohama (JP); Satoshi Kurihara, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/789,497

(22) Filed: Oct. 20, 2017

(65) Prior Publication Data

US 2018/0281501 A1 Oct. 4, 2018

(30) Foreign Application Priority Data

Apr. 4, 2017 (JP) ..... 2017-074688
Apr. 4, 2017 (JP) ..... 2017-074689

(51) Int. Cl.

| | |
|---|---|
| ***B42C 19/02*** | (2006.01) |
| ***B65H 37/04*** | (2006.01) |
| ***B42C 13/00*** | (2006.01) |
| ***B42C 1/12*** | (2006.01) |
| ***B42B 5/00*** | (2006.01) |

(52) U.S. Cl.

CPC ..... *B42C 19/02* (2013.01); *B42B 5/00* (2013.01); *B42C 1/12* (2013.01); *B42C 13/00* (2013.01); *B65H 37/04* (2013.01); *B65H 2301/51616* (2013.01); *B65H 2408/1222* (2013.01); *B65H 2801/27* (2013.01)

(58) Field of Classification Search

CPC ..... B65H 37/04; B65H 2301/43828; B65H 2301/51616; B65H 2408/1222; B31F 1/07; B31F 2201/0707; B31F 2201/0754; G03G 15/6544; G03G 2215/00852

USPC ..... 270/58.08

See application file for complete search history.

(56) References Cited

U.S. PATENT DOCUMENTS

| | | | | |
|---|---|---|---|---|
| 6,450,934 | B1 | 9/2002 | Coombs | |
| 9,090,051 | B2 * | 7/2015 | Takahashi | B31F 5/02 |
| 9,315,356 | B2 * | 4/2016 | Yoshida | G03G 15/6544 |
| 9,440,478 | B2 * | 9/2016 | Takahashi | B42B 5/00 |
| 9,751,276 | B2 * | 9/2017 | Kamiya | B31F 5/02 |
| 10,173,387 | B2 * | 1/2019 | Nobe | B31F 5/02 |

(Continued)

FOREIGN PATENT DOCUMENTS

| | | |
|---|---|---|
| JP | H07-047783 A | 2/1995 |
| JP | 2001-106423 A | 4/2001 |
| JP | 2014-105071 A | 6/2014 |

*Primary Examiner* — Leslie A Nicholson, III
(74) *Attorney, Agent, or Firm* — Oliff PLC

(57) ABSTRACT

A binding unit includes a pressing portion that binds a recording material bundle, which includes a first pressing portion pressing against the recording material bundle in order to bind the recording material bundle and a second pressing portion facing the first pressing portion, an extruding portion that is separately formed from the second pressing portion, and extrudes the second pressing portion toward the first pressing portion, and a driving source that drives the extruding portion, in which the extruding portion is connected to the pressing portion, the pressing portion retracts to a downstream side in a direction where a recording material enters when the recording material enters, and the driving source does not operate in conjunction with movement of the reaction of the pressing portion.

6 Claims, 14 Drawing Sheets

(56) References Cited

U.S. PATENT DOCUMENTS

| | | | | |
|---|---|---|---|---|
| 2018/0015769 | A1* | 1/2018 | Nobe | B31F 5/02 |
| 2018/0016110 | A1* | 1/2018 | Nobe | B65H 37/04 |
| 2018/0017927 | A1* | 1/2018 | Nobe | B65H 37/04 |

* cited by examiner

--Related Art--

--Related Art--

BINDING DEVICE AND IMAGE PROCESSING APPARATUS

CROSS-REFERENCE TO RELATED APPLICATIONS

This application is based on and claims priorities under 35 USC 119 from Japanese Patent Application No. 2017-074688 filed on Apr. 4, 2017 and Japanese Patent Application No. 2017-074689 filed on Apr. 4, 2017.

BACKGROUND

Technical Field

The present invention relates to a binding device and an image processing apparatus.

Related Art

In a general binding device of the related art, in the case of advancing the binding device when binding is performed by retracting the binding device at the time of standby, a driving source for binding is also advanced and retracted.

In addition, in a stapler device with a needle of the related art, since a binding load is not large, it is also possible to provide a pressing mechanism in a frame of the stapler device with a needle separately from a pressing portion by advancing and retracting the pressing portion alone.

SUMMARY

According to an aspect of the invention, there is provided a binding device including:

a pressing portion that binds a bundle of recording materials and includes a first pressing portion pressing against the bundle of the recording materials and a second pressing portion facing the first pressing portion and pressing against the bundle of the recording materials;

an extruding portion that is connected to the pressing portion and extrudes the second pressing portion toward the first pressing portion; and a driving source that drives the extruding portion.

In the binding device, when the recording material is transported to a position where the second pressing portion is configured to face the first pressing portion, the pressing portion retracts to a downstream side in a transport direction of the recording materials, whereas the driving source does not retract in conjunction with the retraction of the pressing portion.

BRIEF DESCRIPTION OF THE DRAWINGS

Exemplary embodiment(s) of the present invention will be described in detail based on the following figures, wherein.

DETAILED DESCRIPTION

Hereinafter, an exemplary embodiment of the invention will be described in detail with reference to attached drawings.

<Recording Material Processing System 500>

Figure 1:
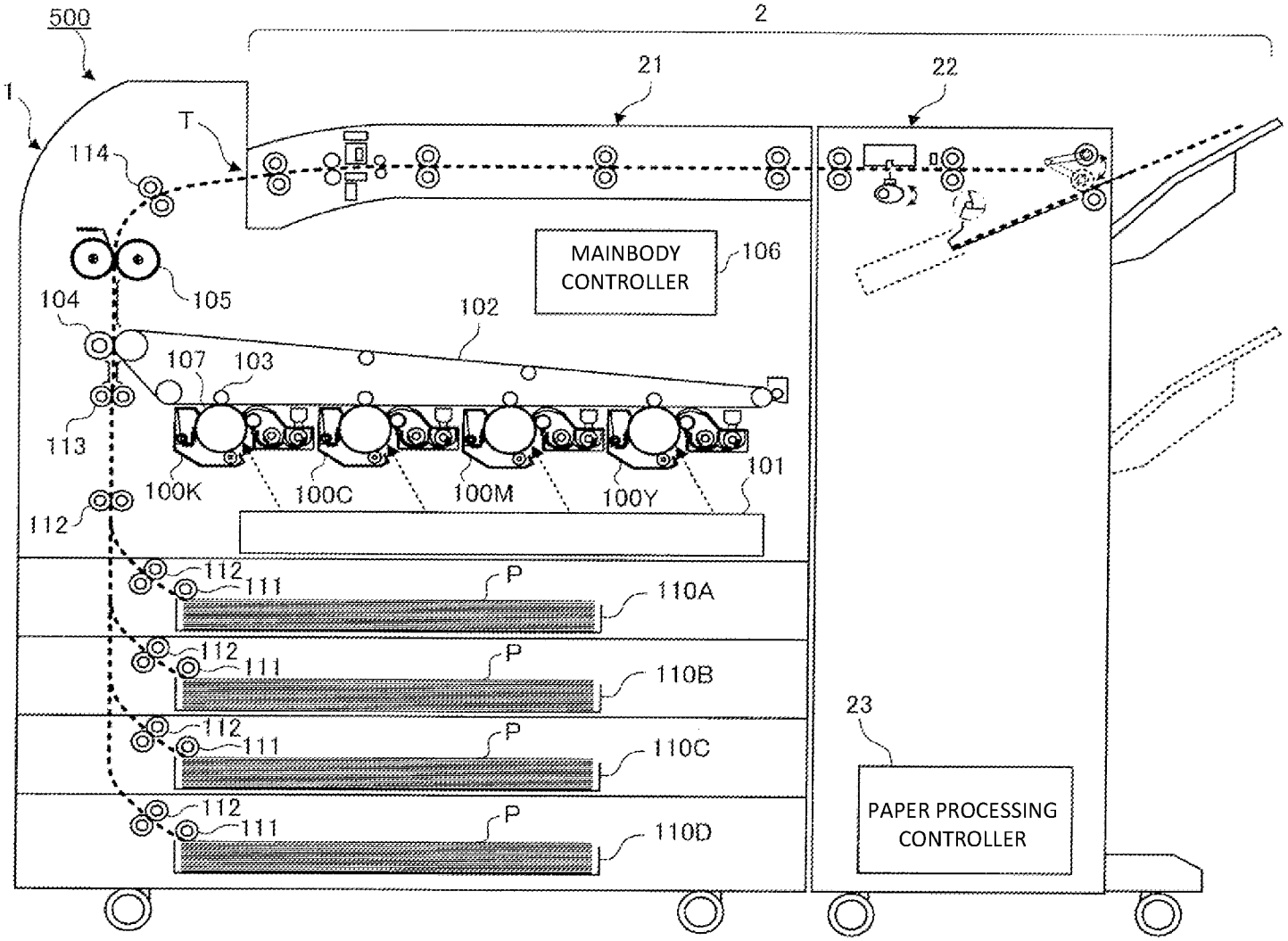
FIG. 1 is a view illustrating a configuration of a recording material processing system to which an exemplary embodiment is applied.

FIG. 1 is a view illustrating a recording material processing system 500 to which the exemplary embodiment is applied.

The recording material processing system 500 which functions as one of image processing apparatuses is provided with an image forming apparatus 1 which forms an image on a recording material (sheet) such as paper P by an electrophotographic process or the like using an image forming portion, and a post-process device 2 which performs a post-process on plural sheets of the paper P on which an image is formed by the image forming apparatus 1 are placed. Also, the image forming apparatus 1 or the post-process device 2 also functions as one of the image processing apparatuses as a single unit.

<Image Forming Apparatus 1>

The image forming apparatus 1 is provided with four image forming units 100Y, 100M, 100C, and 100K (collectively referred to as an "image forming unit 100") which form an image based on data relating to each color image. In addition, the image forming apparatus 1 is provided with a laser exposure device 101 which exposes a photoconductor drum 107 placed on each image forming unit 100 and forms an electrostatic latent image on a surface of the photoconductor drum 107.

In addition, the image forming apparatus 1 is provided with an intermediate transfer belt 102 where a toner image of each color formed by each image forming unit 100 is multiply transferred, and a primary transfer roll 103 which sequentially transfers (primary transfers) the toner image of each color formed by each image forming unit 100 to the intermediate transfer belt 102. Further, a secondary transfer roll 104 which collectively transfers (secondary transfers) a toner image of each color transferred onto the intermediate transfer belt 102 on the paper P, a fixing device 105 which fixes the toner image of each color which is secondary transferred onto the paper P, and a main body controller 106 which controls operations of the image forming apparatus 1 are placed.

Each image forming unit 100 performs charging of the photoconductor drum 107, and forming of the electrostatic latent image onto the photoconductor drum 107. Also, the electrostatic latent image is developed, and the toner image of each color is formed on the surface of the photoconductor drum 107.

The toner image of each color formed on the surface of the photoconductor drum 107 is sequentially transferred onto the intermediate transfer belt 102 by the primary transfer roll 103. Also, the toner image of each color is transported to a position where the secondary transfer roll 104 is placed according to movement of the intermediate transfer belt 102.

Different sizes or different types of the paper P are collected in paper collecting portions 110A to 110D of the image forming apparatus 1. Also, for example, the paper P is retrieved from the paper collecting portion 110A by a pickup roll 111, and is transported to a registration roll 113 by a transport roller 112.

In accordance with a timing when the toner image of each color on the intermediate transfer belt 102 is transported to the secondary transfer roll 104, the paper P is supplied from the registration roll 113 to a facing portion (secondary transfer portion) where the secondary transfer roll 104 faces the intermediate transfer belt 102.

Also, the toner image of each color on the intermediate transfer belt 102 is collectively and electrostatically transferred (secondary transferred) on the paper P due to action of a transfer electric field generated by the secondary transfer roll 104.

After that, the paper P, to which the toner image of each color is transferred is peeled off from the intermediate transfer belt 102, and is transported to the fixing device 105. In the fixing device 105, the toner image of each color is fixed onto the paper P through a fixing process with heat and pressure, and thus the image is formed on the paper P.

Also, the paper P, on which the image is formed, is exited from a paper exit portion T of the image forming apparatus 1 by the transport roller 114, and is supplied to the post-process device 2 connected to the image forming apparatus 1.

The post-process device 2 is disposed on a downstream side of the paper exit portion T of the image forming apparatus 1, and performs a post-process such as boring or binding with respect to the paper P on which the image is formed.

<Post-Process Device 2>

Figure 2:
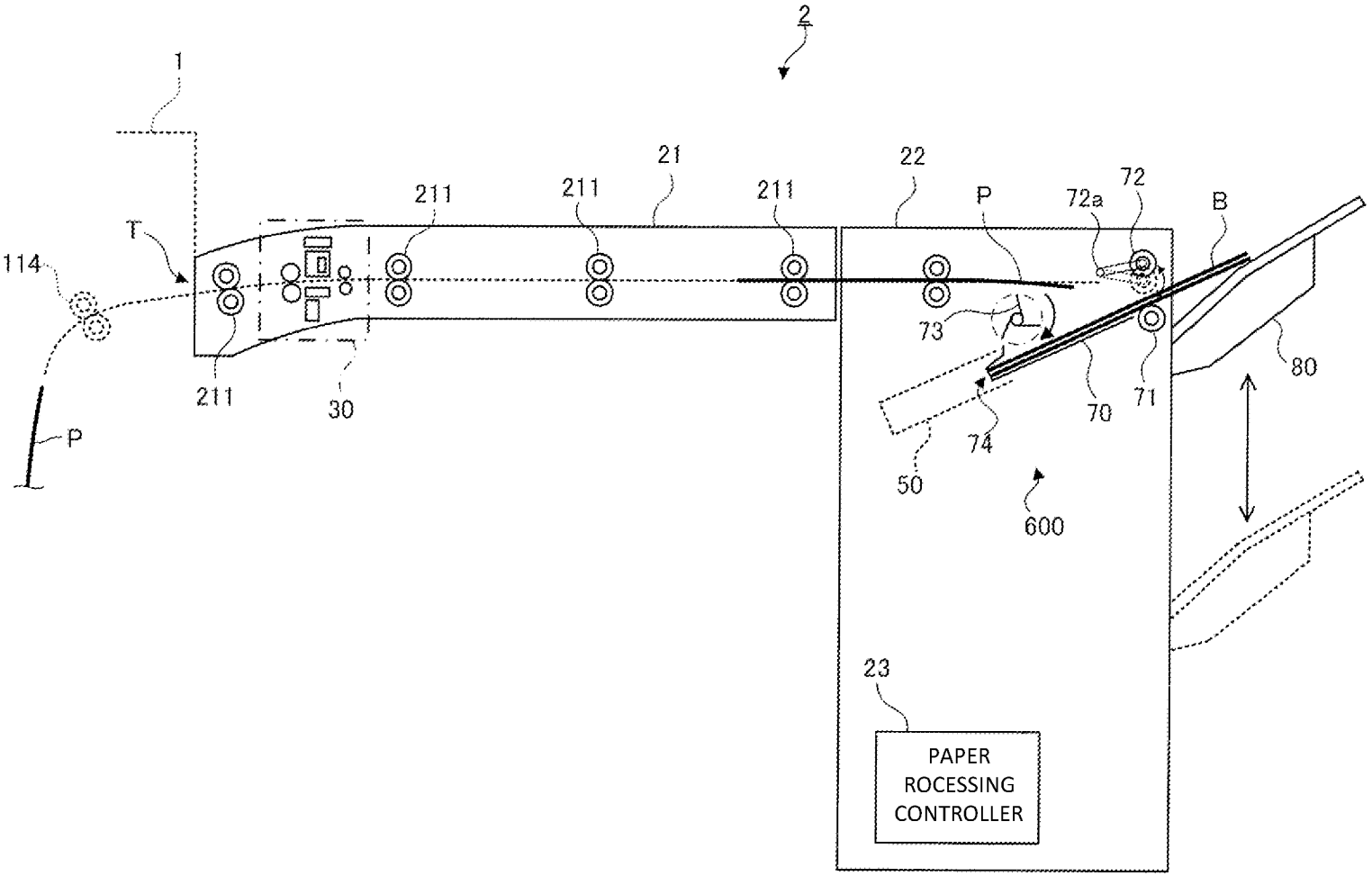
FIG. 2 is an explanatory view of a configuration of a post-process device to which the exemplary embodiment is applied.

FIG. 2 is an explanatory view of a configuration of the post-process device 2.

As illustrated in FIG. 2, the post-process device 2 which functions as one of the image processing apparatuses is provided with a transport unit 21 connected to the paper exit portion T of the image forming apparatus 1, and a finisher unit 22 which performs a process set in advance on the paper P transported by the transport unit 21. Various transporting paths of the transport unit 21 or the finisher unit 22 function as one of transporting portions which transport a recording material on which an image is formed. The transporting path after the image forming apparatus 1 forms an image also functions as one of the transporting portions.

The post-process device 2 is provided with a paper processing controller 23 which controls each of mechanism portions of the post-process device 2. The paper processing controller 23 is connected to the main body controller 106 (refer to FIG. 1) through a signal line which is not illustrated, and these controllers mutually transmit and receive control signals and the like.

In addition, the post-process device 2 is provided with a stacking portion 80 where the paper P (paper bundle B) which finishes to be processed by the post-process device 2 is stacked.

As illustrated in FIG. 2, the transport unit 21 of the post-process device 2 is provided with a punching function portion 30 which performs boring (punching) two holes, four holes, and the like.

Further, the transport unit 21 is provided with plural transport rollers 211 which transports the paper P on which an image is formed by the image forming apparatus 1 toward the finisher unit 22.

The finisher unit 22 is provided with a binding processing device 600 which performs the binding process on the paper bundle B as an example of a recording material bundle. The binding processing device 600 of the exemplary embodiment functions as one of binding portions, and performs the binding process on the paper bundle B by making fibers constituting the paper P be entangled with each other without using a staple (needle).

The binding processing device 600 is provided with a paper accumulating portion 70 which generates the paper bundle B by supporting the paper P from the bottom and accumulating the paper P as necessary number of sheets. The paper accumulating portion 70 functions as one of collecting portions which collect a recording material bundle in which the recording materials transported by the transporting portion are bundled. In addition, the binding processing device 600 is provided with a binding unit 50 which performs the binding process on the paper bundle B. Also, the paper accumulating portion 70 functions as one of holding portions holding the paper bundle B which is the recording material bundle. In the paper accumulating portion 70, there is an aspect in which the paper P is collectively collected as the paper bundle B, in addition to an aspect in which the paper bundle B, in which the paper P is collected one by one, is collected.

The binding processing device 600 is provided with an exit roll 71 and a moving roll 72. The exit roll 71 rotates in a clockwise direction in drawings, and transports the paper bundle B on the paper accumulating portion 70 to the stacking portion 80.

The moving roll 72 is placed to be movable based on the rotating shaft 72*a*, and is positioned on a part retracted from the exit roll 71 at the time of accumulating the paper P in the paper accumulating portion 70. In addition, the moving roll 72 firmly presses the paper bundle B on the paper accumulating portion 70, at the time of transporting the generated paper bundle B to the stacking portion 80.

Processes being performed by the post-process device 2 will be described.

In the exemplary embodiment, an instruction signal for performing a process with respect to the paper P is output from the main body controller 106 to the paper processing controller 23. When the paper processing controller 23 receives the instruction signal, the post-process device 2 performs the process with respect to the paper P.

In a process by the post-process device 2, first, the paper P on which an image is formed by the image forming apparatus 1 is supplied to the transport unit 21 of the post-process device 2. In the transport unit 21, boring is performed by the punching function portion 30 in accordance with the instruction signal from the paper processing controller 23, and then the paper P is transported toward the finisher unit 22 by the transport roller 211.

Also, in a case in which there is no boring instruction from the paper processing controller 23, the paper P is transported to the finisher unit 22 without performing a boring process by the punching function portion 30.

The paper P transported to the finisher unit 22 is transported to the paper accumulating portion 70 placed in the binding processing device 600. Also, the paper P slides over the paper accumulating portion 70 at an inclined angle applied to the paper accumulating portion 70, and reaches a paper regulating portion 74 placed on an end portion of the paper accumulating portion 70.

Therefore, the paper P stops to move. In the exemplary embodiment, the paper bundle B in a state in which rear end portions of the paper P are aligned is generated on the paper accumulating portion 70 when the paper P reaches the paper regulating portion 74. Also, in the exemplary embodiment, a rotating paddle 73 which moves the paper P toward the paper regulating portion 74 is placed.

Figure 3:
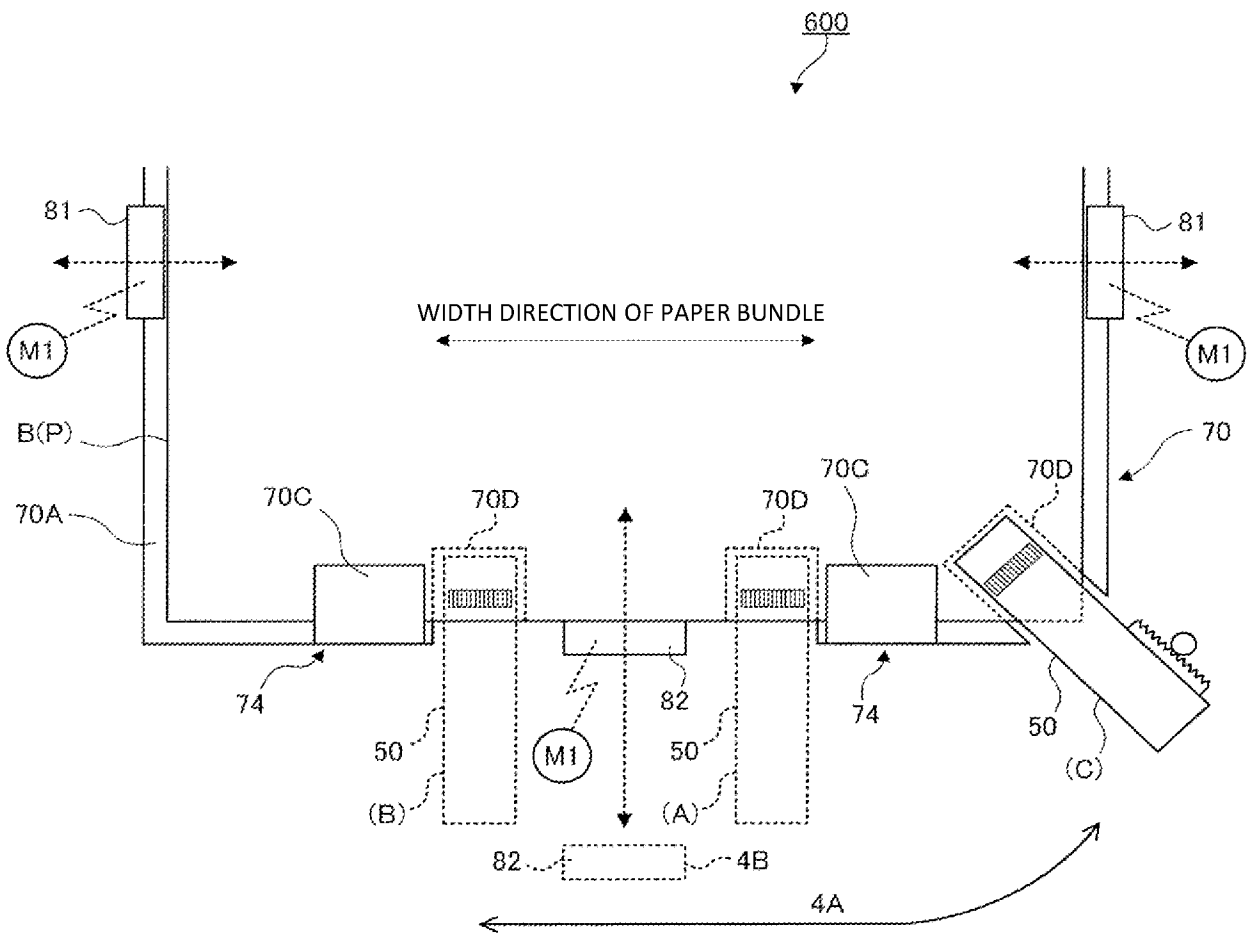
FIG. 3 is a view illustrating a binding processing device to which the exemplary embodiment is applied when seen from the above.

FIG. 3 is a view illustrating the binding processing device 600 seen from the above.

First moving members 81 are respectively placed on both end portions in a width direction of the paper accumulating portion 70.

The first moving member 81 firmly presses a side of the paper P constituting the paper bundle B, and causes positions of end portions of the paper P constituting the paper bundle B to be aligned. In addition, the first moving member 81 moves in a width direction of the paper bundle B, and causes the paper bundle B to move in the width direction of the paper bundle B.

Specifically, in the exemplary embodiment, at the time of accumulating the paper P on the paper accumulating portion 70, the first moving member 81 firmly presses the side of the paper P, and a position of the side of the paper P is aligned.

In addition, as described later, in a case in which a binding position of the paper bundle B is changed, the paper bundle B is pressed by the first moving member 81, and the paper bundle B moves in the width direction of the paper bundle B.

Further, the binding processing device 600 of the exemplary embodiment is provided with a second moving member 82.

The second moving member 82 moves in a vertical direction in drawings, and causes the paper bundle B to move in a direction orthogonal to the width direction of the paper bundle B.

Further, in the exemplary embodiment, a motor M1 for moving the first moving member 81 and the second moving member 82 is placed.

As illustrated in an arrow 4A of FIG. 3, the binding unit 50 is placed to be movable in the width direction of the paper P. Also, for example, the binding unit 50 performs the binding process (two-point binding process) on two parts ((A) position and (B) position) positioned on different parts in the width direction of the paper bundle B.

In addition, the binding unit 50 moves to a (C) position of FIG. 3, and performs the binding process (one-point binding) on each angle portion of the paper bundle B.

Also, the binding unit 50 linearly moves between the (A) position and the (B) position, but the binding unit 50 moves, for example, while rotating 45° between the (A) position and the (C) position.

The paper regulating portion 74 is formed in a U shape. Inside the U shape, a regulating portion (not illustrated) extending upward from a bottom plate 70A is placed, and the regulating portion is in contact with a front end portion of the transported paper P and regulates movement of the paper P. In addition, the paper regulating portion 74 which is formed in a U shape includes a facing portion 70C which is disposed to face the bottom plate 70A. The facing portion 70C is in contact with the paper P on the top in the paper bundle B, and regulates movement of the paper P in a thickness direction of the paper bundle B.

In the exemplary embodiment, the binding unit 50 performs the binding process on a part where the paper regulating portion 74 and the second moving member 82 are not placed.

Specifically, as illustrated in FIG. 3, the binding unit 50 performs the binding process between the paper regulating portion 74 and the second moving member 82 positioned on a left side in the drawings and between the paper regulating portion 74 and the second moving member 82 positioned on a right side. Further, in the exemplary embodiment, the binding process is performed on a part (angle portion of paper bundle B) adjacent to the paper regulating portion 74 on a right side of the drawings.

Also, as illustrated in FIG. 3, three notches 70D are placed on the bottom plate 70A. Therefore, interference between the paper accumulating portion 70 and the binding unit 50 is avoided.

In addition, in the exemplary embodiment, when the binding unit 50 moves, the second moving member 82 moves to a position illustrated by a reference numeral 4B of FIG. 3. Therefore, interference between the binding unit 50 and the second moving member 82 is avoided.

<Structure of Binding Unit 50>

Next, the binding unit 50 which is a characteristic configuration of the exemplary embodiment will be described in detail. The binding unit 50 to which the exemplary embodiment is applied functions as the binding device which binds the recording material bundle (paper bundle B) without using a needle. For example, the paper bundle B is bound by pressing against two to ten sheets of the paper bundle B using upper teeth and lower teeth. At this time, particularly, in order to well bind the paper bundle B which is constituted by many sheets, a significant large pressing force is required. In the binding unit 50 to which the exemplary embodiment is applied, with a configuration to be described later, for example, the pressing force as 10,000 Newtons is realized. In addition, even the binding device where such a large pressing force is obtained, downsizing is realized as its shape, and it is possible to realize that the binding device is replaced with the stapler device having a needle of the related art, or is disposed at the same place. In addition, the stapler device having a needle of the related art may be opened largely at the time of standby, but a binding device without a needle is generally difficult to open largely. However, in the binding unit 50 to which the exemplary embodiment is applied, at the time of the standby, a sufficient opening is secured using mechanisms to be described later.

Figure 4:
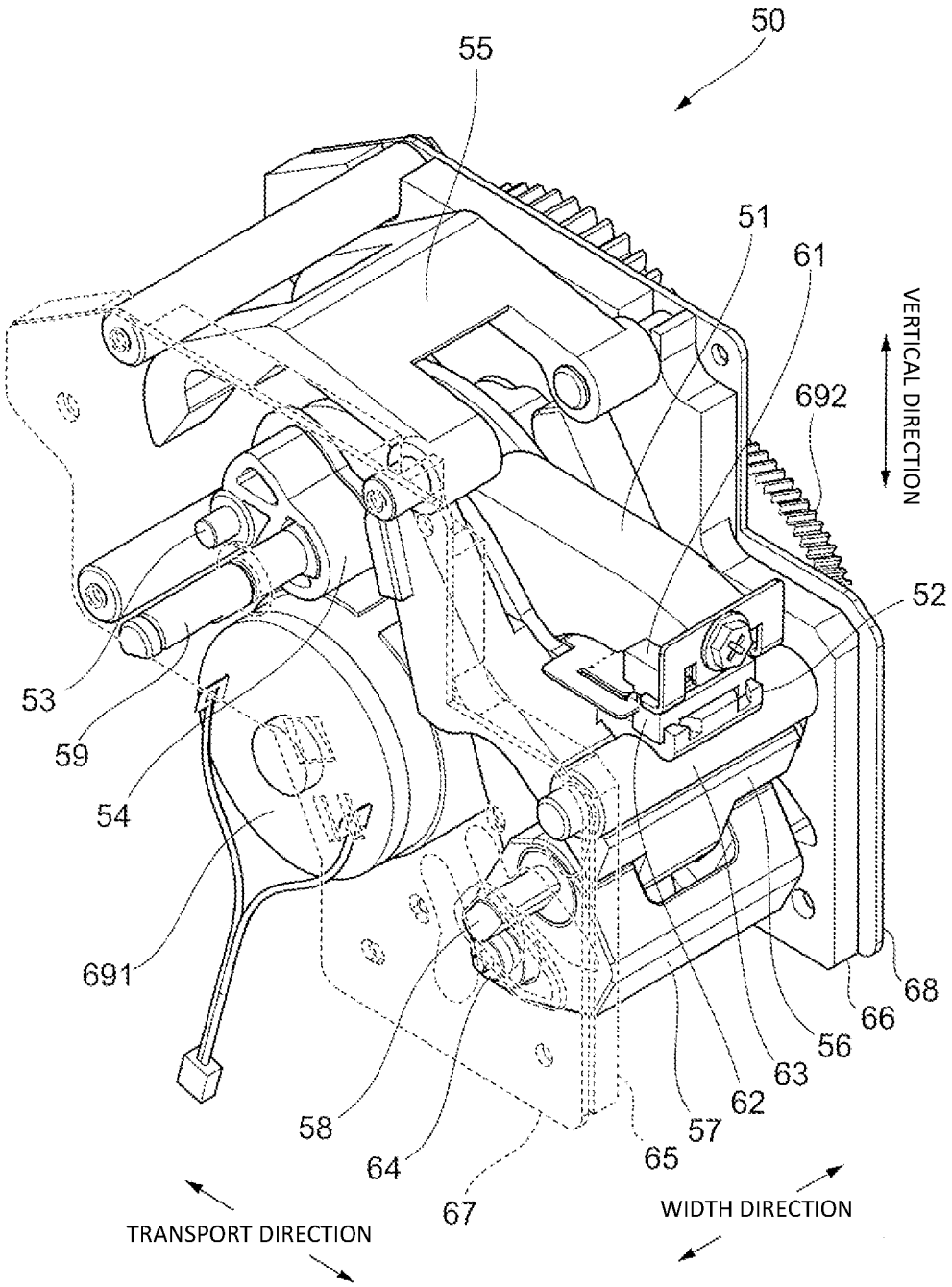
FIG. 4 is a perspective view of a binding unit to which the exemplary embodiment is applied.
Figure 5A:
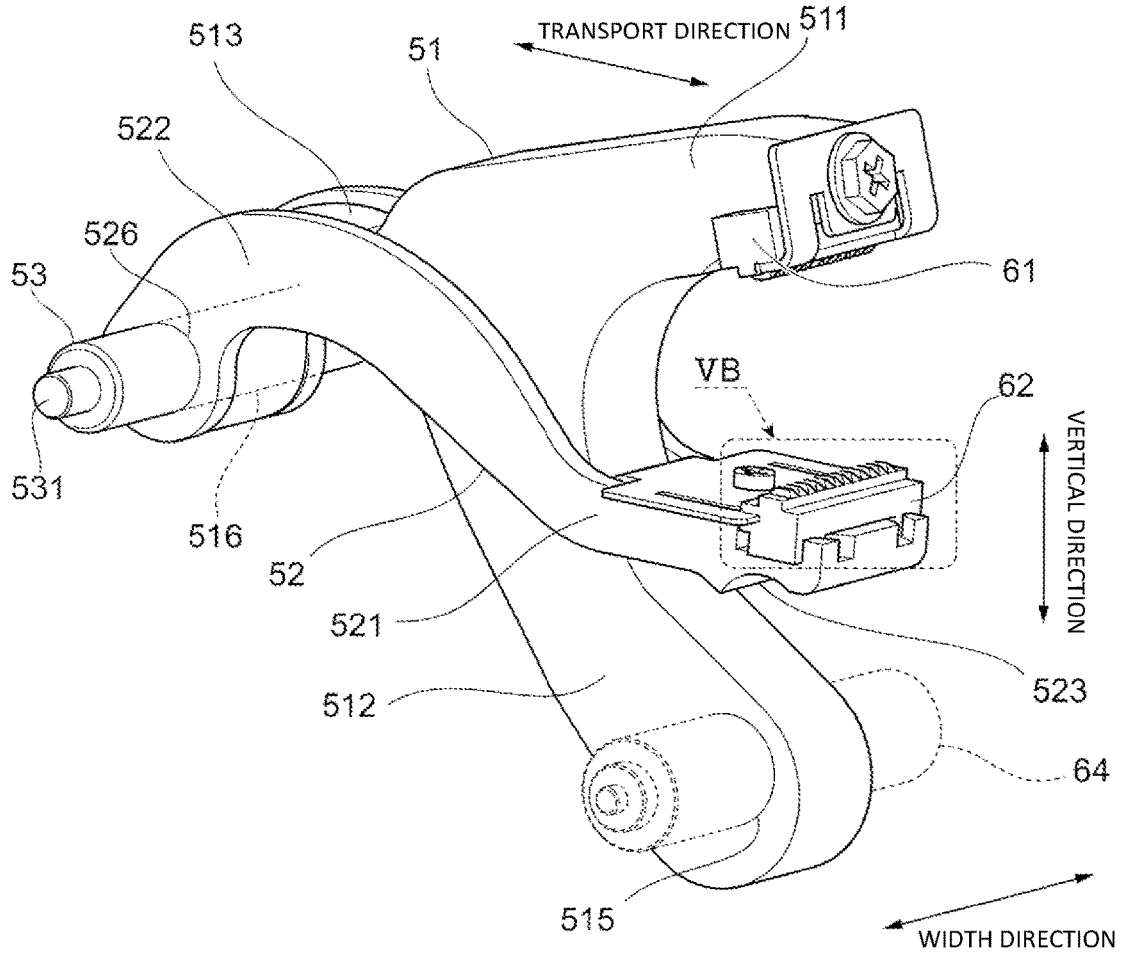
FIG. 5A is an explanatory view of a part being in contact with a paper bundle of the binding unit to which the exemplary embodiment is applied.
Figure 6:
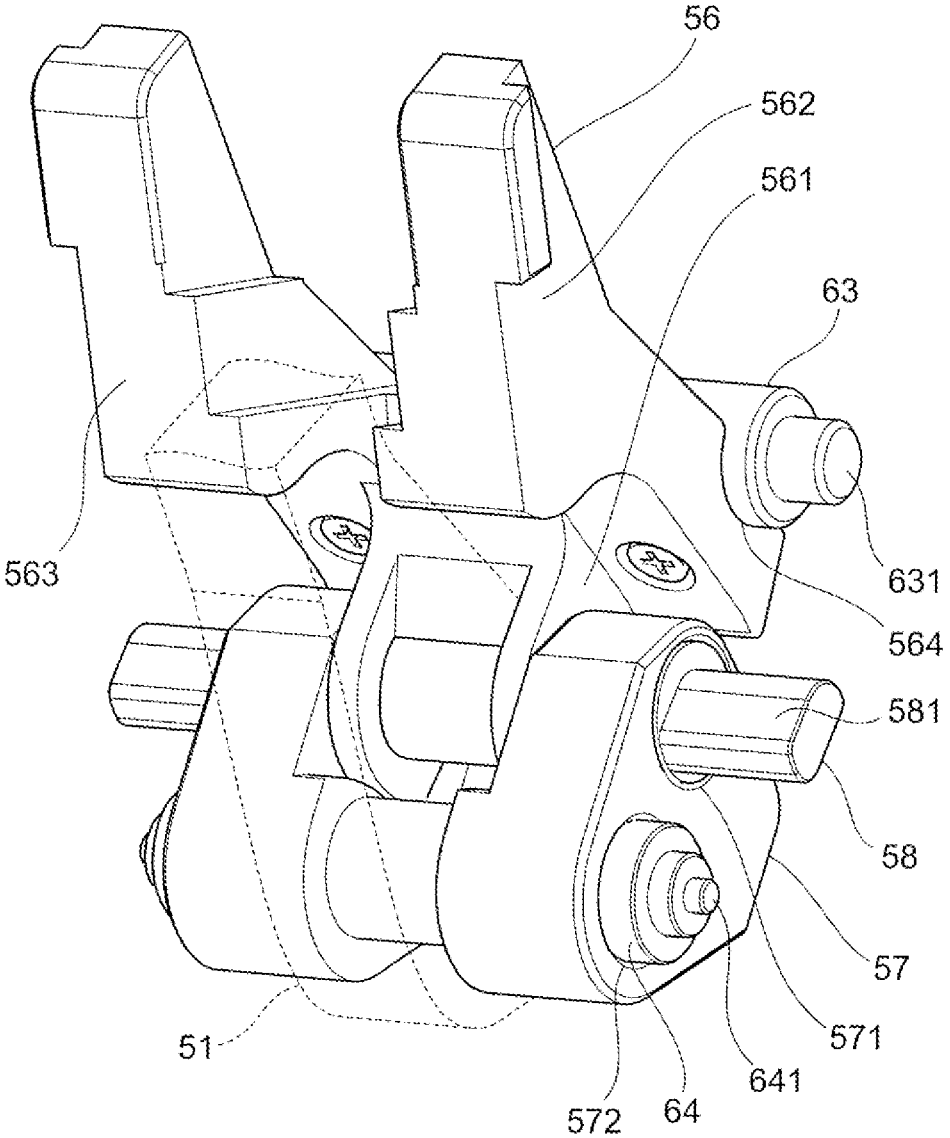
FIG. 6 is an explanatory view of a pressing structure of the binding unit to which the exemplary embodiment is applied.
Figure 7:
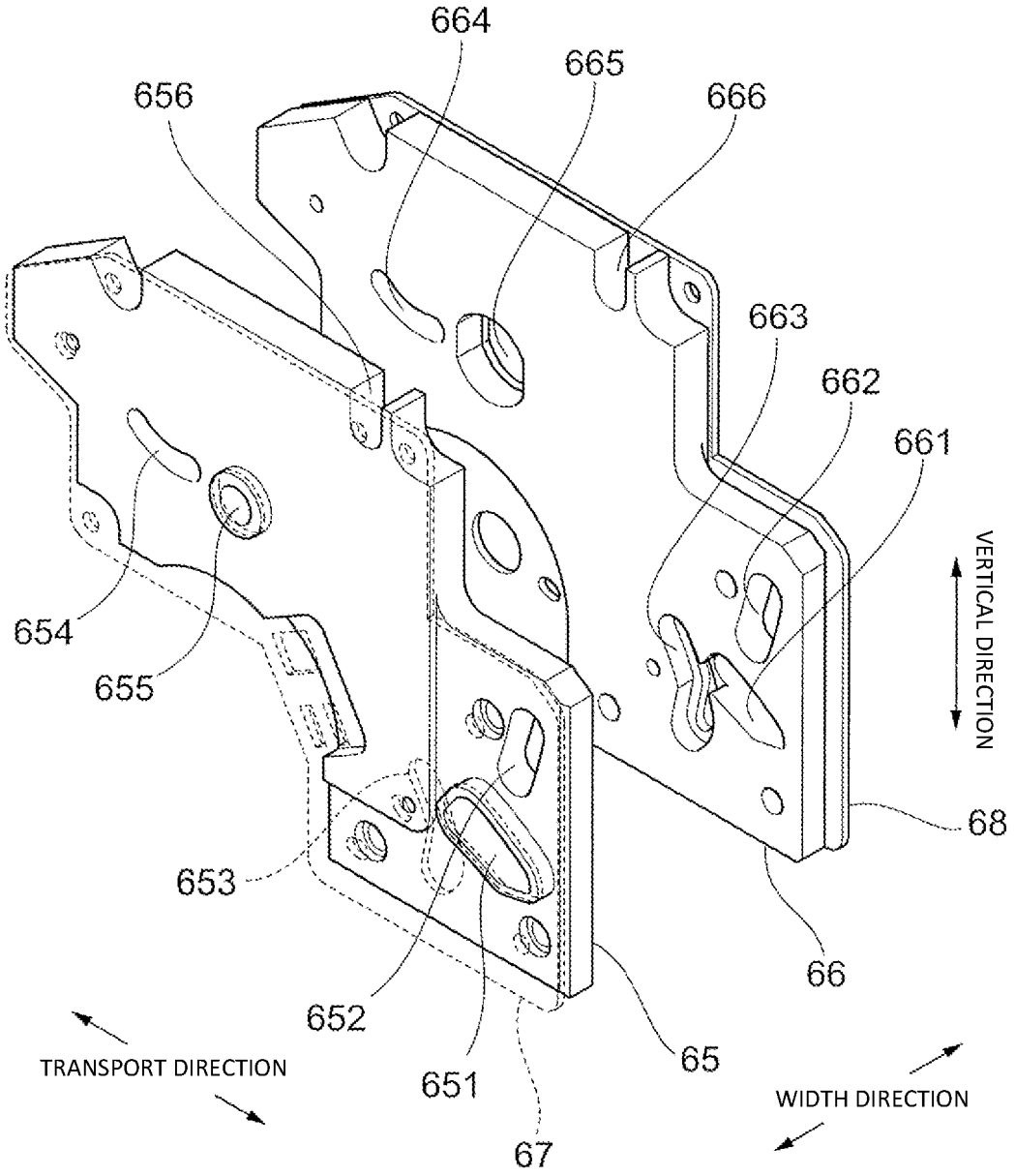
FIG. 7 is an explanatory view of a guide portion which guides an operation of each structure of the binding unit to which the exemplary embodiment is applied.

First, a structure of the binding unit 50 will be described with reference to FIGS. 4 to 8. FIG. 4 is perspective view of the binding unit 50 to which the exemplary embodiment is applied, FIG. 5A is an explanatory view of a part being in contact with the paper bundle of the binding unit 50, FIG. 6 is an explanatory view of a pressing structure of the binding unit 50, and FIG. 7 is an explanatory view of a guide portion which guides operations of each structure of the binding unit 50. In addition, FIG. 8 is an exploded view of the binding unit 50.

Also, in description hereinafter, the width direction of the paper bundle B illustrated in FIG. 3 is simply referred to as a "width direction", a thickness direction of the paper bundle B is simply referred to as a "vertical direction", and a transporting direction of the transported paper bundle B is simply referred to as a "transporting direction".

Figure 8:
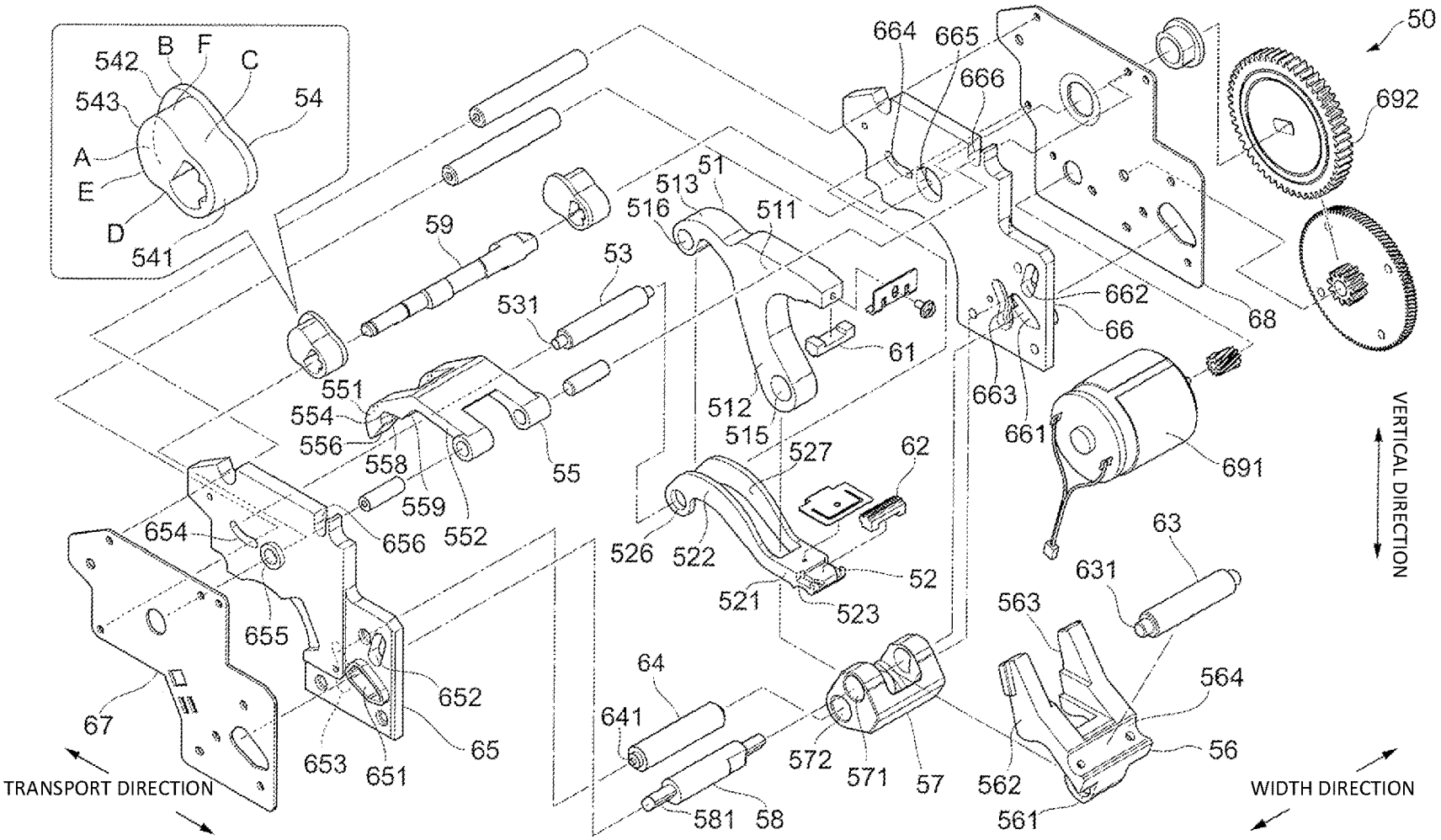
FIG. 8 is an exploded view of the binding unit to which the exemplary embodiment is applied.

As illustrated in FIGS. 4, 5, and 8, the binding unit 50 to which the present embodiment is applied includes a upper arm 51, which includes an upper teeth 61 at one end and is intended to press against and deform the paper bundle B in the thickness direction, and a lower arm 52, which includes a lower teeth 62 facing the upper teeth 61 at one end and is intended to press against and deform the paper bundle B in the thickness direction. In addition, the binding unit includes a shaft arm 53 connecting the upper arm 51 and the lower arm 52. The upper teeth 61 of the upper arm 51 and the lower teeth 62 of the lower arm 52 move through the shaft arm 53 which is the pivot point, whereby their facing relationship is changed, and the shaft arm 53 which is the pivot point moves in the transporting direction (moving direction) of the paper P or the paper bundle B entering the pressing region and thus retracts or protrudes.

The upper arm 51 which functions as an arm member includes one end portion 511 including the upper teeth 61, and the other end portion 512. The upper arm 51 integrally extends from the one end portion 511 the other end portion 512 and bend between the one end portion 511 and the other end portion 512. In addition, the upper arm 51 includes a supporting portion 513 which supports the upper arm 51 near a bending point between the one end portion 511 and the other end portion 512. The one end portion 511 of the upper arm 51 functions as a first pressing portion which presses against the paper bundle B.

The other end portion 512 includes a link connecting hole 515 which is a starting point for extruding the lower arm 52 toward the upper arm 51 by an extrusion link structure (to be described later). A shaft lever lower 64 (to be described later) is inserted into the link connecting hole 515. The link connecting hole 515 and the shaft lever lower 64 becomes a starting point portion of movement of the extrusion link structure. In addition, in the supporting portion 513, a rotating center hole 516 which becomes a rotating center of the upper arm 51 is placed.

The upper arm 51 has a substantially uniform thickness in the width direction, and only one part thereof is bent so as to be a V shape (or U shape or L shape) in the transporting direction. More specifically, a virtual line connecting the one end portion 511 including the upper teeth 61 which is the first pressing portion and the rotating center hole 516 which is the rotating shaft, and a virtual line connecting the link connecting hole 515 which is a starting point and is placed in the other end portion 512 and the rotating center hole 516 intersect each other. In addition, the upper arm 51 including the one end portion 511 and the other end portion 512 is formed of a single member. In the exemplary embodiment, as a material of the upper arm 51 which is a single member, chrome molybdenum steel is adopted. The chrome molybdenum steel has higher strength and hardness than a general carbon steel. In addition, the chrome molybdenum steel is a material having appropriate "flexibility".

The lower arm 52 which functions as an arm structure includes one end portion 521 including the lower teeth 62 which functions as a second pressing portion, and another end portion 522 extending substantially in one direction from the one end portion 521. The one end portion 521 of the lower arm 52 functions as the second pressing portion. The one end portion 521 side including the lower teeth 62 is provided with a recess 523 facing an action point of the extrusion link structure (to be described later) for extruding the lower arm 52 toward the upper arm 51. In the action point of the extrusion link structure, a shaft lever upper 63 to be described later is placed. Also, a cross-sectional surface of the recess 523 is formed in a curved shape having a diameter equal to or greater than the shaft lever upper 63, and is placed substantially vertically below a part including the lower teeth 62 in the one end portion 521 of the lower arm 52. The recess 523 and the shaft lever upper 63 are an action point of movement of the extrusion link structure.

The other end portion 522 of the lower arm 52 including an arm structure is provided with a rotating center hole 526 which is the rotating center of the lower arm 52, and rotatably holds the lower arm 52 coaxial with the rotating center hole 516 which is the rotating center of the upper arm 51.

That is, the rotating center hole 516 of the upper arm 51 and the rotating center hole 526 of the lower arm 52 are coaxially held by the shaft arm 53. Also, the shaft arm 53 includes small diameter portions 531 on both end portions, and the small diameter portion 531 is engaged to notches having an elongated hole shape (arm guides 654 and 664 to be described later) which are placed in guide members (left side guide 65 and right side guide 66 to be described later) placed on both end portions in the width direction.

Accordingly, the shaft arm 53 is configured with a movable component in a transporting direction to be described later so as to be movable, and holds the upper arm 51 and the lower arm 52 to be movable in the transporting direction (direction where paper bundle B moves in and out). In addition, the lower arm 52 is provided with a notch 527 which allows movement in a vertical direction of the upper arm 51.

Moreover, in the exemplary embodiment, the one end portion 511 of the upper arm 51 including the upper teeth 61 functions as the first pressing portion, and the one end portion 521 of the lower arm 52 including the lower teeth 62 functions as the second pressing portion, but these end portions are pressing portions including the upper arm 51 and the lower arm 52.

Here, the upper teeth 61 and the lower teeth 62 are described later in more detail.

Figure 5B:
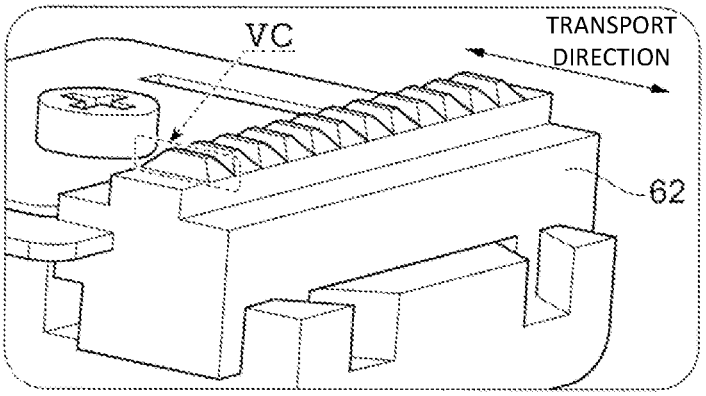
FIG. 5B is an enlarged view of a part of VB of FIG. 5A.

FIG. 5B is an enlarged view of a part of VB illustrated in FIG. 5A and an explanatory view of the lower teeth 62. In addition, FIG. 5C is a view illustrating a partial cross-section of a tooth of a part of VC illustrated in FIG. 5B.

Figure 5C:
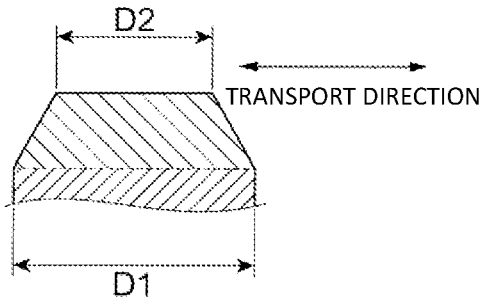
FIG. 5C is a partial cross-sectional view of a part of VC of FIG. 5B.

As illustrated in FIGS. 5B and 5C, regarding the lower teeth 62, a shape of the teeth making a binding mark on the paper bundle B is as follows. A width D2 of a tooth tip is narrower than a width D1 of a tooth root in the transporting direction (direction where a recording material enters) of the paper P or the paper bundle B. That is, regarding the shape of the tooth of the teeth which perform a needleless binding, a cross-section of the teeth of a part forming the binding mark is a trapezoidal shape, and the tooth tip is thinner than the tooth root. For example, the tooth tip may be set to approximately 1 mm, and the tooth root may be set to approximately 4 mm to 5 mm.

Here, the exemplary embodiment using only the lower teeth 62 is described, but the upper teeth 61 also has a similar configuration.

Regarding the upper teeth 61 and the lower teeth 62, the tooth tip more tapers than the tooth root, and thus contacting of the teeth to the paper bundle B in a line shape may be made to be close to a point shape, when compared a case in which the width D2 of the tooth tip is set to be equal to the width D1 of the tooth root, or is set to be greater than the width D1 of the tooth root. That is, the contact of the teeth may approximate to a line contact from a surface contact. As described later, in the exemplary embodiment, since an extruding direction is inclined with respect to a binding direction using an extruding structure with a jack structure using a link, a balance of the teeth is adjusted by making the shape of the tooth tip approximate to the line contact.

Next, the extrusion link structure which is operated based on the link connecting hole 515 placed in the upper arm 51 as a starting point will be described with reference to FIGS. 4, 6, and 8. The extrusion link structure functions as one of extruding portions (extruding structures). That is, the extruding portion (extruding structure) is connected to the other end portion 512 which is another end side of the upper arm 51 constituting the pressing portion through the link connecting hole 515.

The extrusion link structure in the binding unit 50 causes the lower arm 52 to move in the vertical direction by extension and contraction of a lever 56 and a link 57. A spindle 58 is placed in a connected part (joint) of the lever 56 and the link 57.

The lever 56 includes a connecting portion 561 connected to the spindle 58 and a main body portion 562 extending from the connecting portion 561. A contact surface 563 being in contact with a cam 54 to be described later is placed in one end of the main body portion 562, and a pushing-up portion 564 which pushes up the lower arm 52 is placed in another end of the main body portion 562. The shaft lever upper 63 being in contact with the lower arm 52 is attached to the pushing-up portion 564. The shaft lever upper 63 is a cylindrical shape, and the small diameter portions 631 having a small diameter are formed on both end portions of the shaft lever upper and are engaged with notches (pushing-up guides 652 and 662 to be described later) placed in the guide member (left side guide 65 and right side guide 66 to be described later). The shaft lever upper 63 in a cylindrical shape is in contact with the recess 523, which is a curved shape, of the lower arm 52, and a degree of freedom is given to a contacting part when the cylindrical shape and the curved shape are brought into contact with each other.

The link 57 includes a connecting portion 571 being connected to the spindle 58 on one end thereof, and includes a starting point connecting portion 572 connected to the link connecting hole 515 of the upper arm 51 by the shaft lever lower 64 (to be described later) on the other end thereof. The starting point connecting portion 572 functions as a starting point portion of the extrusion link structure which is the extruding portion. In addition, as described above, the shaft lever upper 63 functions as an action point of the extrusion link structure which is the extruding portion. The extrusion link structure which is the extruding portion causes the one end portion 521 of the lower arm 52 to extrude toward the one end portion 511 of the upper arm 51 by changing a distance between the starting point portion which is a starting point at the time of extruding and the action point.

The spindle 58 is a cylindrical shape, and a plate-shaped portions 581 which are placed on both end portions thereof and include a flat portion are engaged with notches (spindle guides 651 and 661 to be described later) placed in the guide members (left side guide 65 and right side guide 66 to be described later).

The shaft lever lower 64 which is a starting point of the extrusion link structure is placed in the starting point connecting portion 572, and the shaft lever lower 64 is inserted into the link connecting hole 515 placed in the upper arm 51. Accordingly, the upper arm 51 is connected to the extrusion link structure. The shaft lever lower 64 in a cylindrical shape includes the small diameter portions 641 placed on both end portions thereof, and is engaged with notches (lower guides 653 and 663 to be described later) placed in the guide member (left side guide 65 and right side guide 66 to be described later).

In this way, in the exemplary embodiment, the extruding portion acts on the second pressing portion (recess 523 of lower arm 52) as the action point (shaft lever upper 63, pushing-up portion 564, or the like) and extrudes the second pressing portion with the jack structure using a link changing the distance between the starting point portion (shaft lever lower 64, starting point connecting portion 572, or link connecting hole 515) which is a starting point at the time of extruding and the action point, and the starting point portion is connected to another end side (the other end portion 512) of a member constituting the first pressing portion (upper arm 51) through the link connecting hole 515.

Next, a frame structure of the binding unit 50 will be described with reference to FIGS. 4, 7, and 8. The frame structure includes the left side guide 65 and the right side guide 66 which guide movement of each structure of the binding unit 50, and a left side frame 67 and a right side frame 68 respectively disposed on the outside of the left side guide 65 and the right side guide 66 so as to fix these guides. Moreover, the frame structure may be configured with a left side frame including the left side guide 65 and the left side frame 67 and a right side frame including the right side guide 66 and the right side frame 68, or may be configured with a left side frame including only the left side guide 65 and a right side frame including only the right side guide 66.

The left side guide 65 and the right side guide 66 include the spindle guides 651 and 661 which guide movement of the plate-shaped portion 581 of the spindle 58, and the pushing-up guides 652 and 662 which guide movement of the small diameter portion 631 of the shaft lever upper 63. In addition, the lower guides 653 and 663 which guide movement of the small diameter portion 641 of the shaft lever lower 64, and the arm guides 654 and 664 which guide movement of the small diameter portion 531 of the shaft arm 53 are included. Further, cam rotating shaft holes 655 and 665 which rotatably support a rotating shaft 59 of the cam 54 to be described later, and stopper rotating shaft holes 656 and 666 which rotatably support a rotating portion of a stopper 55 to be described later are included.

The spindle guides 651 and 661, the pushing-up guides 652 and 662, the lower guides 653 and 663, and the arm guides 654 and 664 are an elongated shape, and move in a direction along the elongated shape. Each elongated hole includes a transporting direction component and/or a vertical direction component, the spindle guides 651 and 661 and the arm guides 654 and 664 particularly allow the transporting direction component to move, and the pushing-up guides 652 and 662 and the lower guides 653 and 663 particularly allow the vertical direction component to move.

Next, a driving structure of the binding unit 50 will be described with reference to FIGS. 4 and 8. The binding unit 50 includes a motor 691 which is a driving source, and gear types 692 which transmit driving. In addition, the binding unit 50 includes the cam 54 for generating irregular movement, and a rotating shaft 59 which transmits a driving force, which is obtained through the gear types 692 from the motor 691, to the cam 54. In the exemplary embodiment, the shaft arm 53, the contact surface 563 of the lever 56, and the stopper 55 to be described later come into contact with the cam 54, and performs movement set in advance in accordance with the shape of the cam 54. The motor 691 is fixed to a frame (the right side guide 66 and/or the right side frame 68). In addition, the lever 56 functions as a transmission unit which transmits a driving force from the motor 691, which is a driving source being fixed to the frame, to the pushing-up portion 564 which pushes up (extrudes) the lower arm 52. Also, the transmission unit directly transmits the driving force to the shaft lever upper 63, which is a configuration member of the action point acting an extrusion force by the pushing-up portion 564 which is the extruding portion.

In the cam 54, two eccentric cams having different outer diameter shapes (first cam and second cam) are formed coaxially with each other in the width direction (thickness direction of cam 54). The first cam and the second cam include a cam trough portion 541 having the same amount of eccentricity, and a first cam crest portion 542 and a second cam crest portion 543 having different amounts of eccentricity. The cam trough portion 541 is in contact with the shaft arm 53, the first cam crest portion 542 is in contact with the shaft arm 53 and the stopper 55, and the second cam crest portion 543 is in contact with the contact surface 563 of the lever 56.

The stopper 55 presses the shaft arm 53 in a direction of the cam 54. In addition, the stopper 55 has a function of fixing a position of the shaft arm 53 when the contact surface 563 of the lever 56 is in contact with the cam 54. The stopper 55 includes the front end portion 551 being in contact with the shaft arm 53 and a rear end portion 552 which rotatably supports the stopper 55. The front end portion 551 includes a recess 554, a retracting slide surface 556, a locking slide surface 558, and a lifting slide surface 559 on a lower surface in the vertical direction, and is pressed by a spring not illustrated from an upper surface. The recess 554 is a curved shape, and an inner diameter thereof is equal to or greater than an outer diameter of the shaft arm 53.

<Operation of Binding unit 50>

Subsequently, operations of the binding unit 50 to which the exemplary embodiment is applied will be described in detail.

The operations of the binding unit 50 are performed by movement of the cam 54 receiving driving of the motor 691 through the gear types 692 under the control of the paper processing controller 23. In the exemplary embodiment, the binding unit 50 may move by rotation of a single came using the cam 54. As described later, the cam 54 functions as a fluctuating mechanism which fluctuates at least any one of the first pressing portion and the second pressing portion in a direction where the paper bundle B is pressed against, and functions as a moving mechanism which moves the fluctuated pressing portion (the first pressing portion and the second pressing portion) in a direction where the paper P or the paper bundle B moves in and out.

Also, hereinafter, description will be performed based on an inflection point of the cam 54. As illustrated in FIGS. 8 and 9-1 to 9-3, an inflection point of the first cam crest portion 542 is set to A and B, an inflection point of the cam trough portion 541 is set to C and D, and an inflection point of the second cam crest portion 543 is set to E and F. In addition, it is described that a surface belonging to the first cam crest portion 542 is set to a "A-B surface", a surface belonging to the cam trough portion 541 is set to a "C-D surface", and a surface belonging to the second cam crest portion 543 is set to a "E-F surface".

Figure 9A:
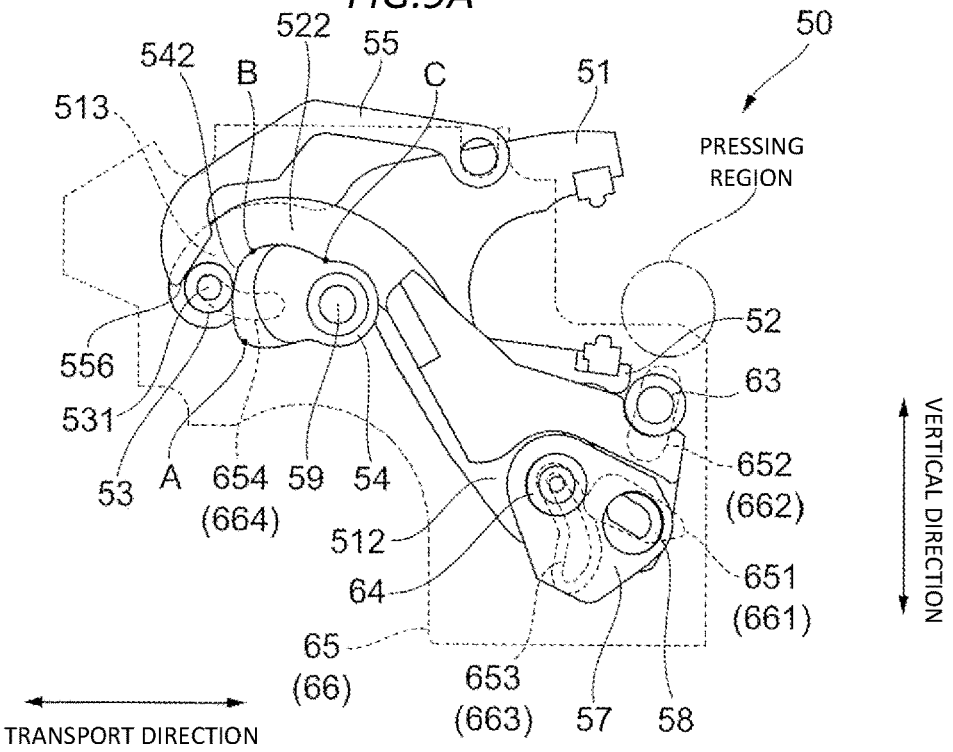
FIG. 9A is an explanatory view of a retracting state of the binding unit to which the exemplary embodiment is applied.
Figure 9B:
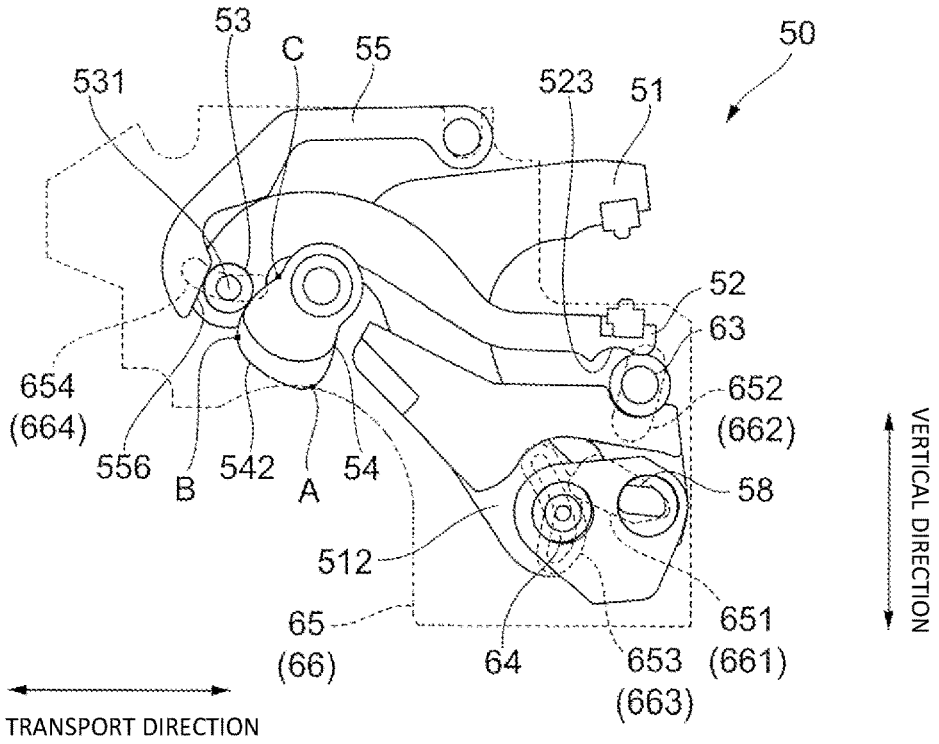
FIG. 9B is an explanatory view of the retracting state of the binding unit to which the exemplary embodiment is applied.

FIGS. 9A and 9B are explanatory views of a retracting state of the binding unit 50. FIG. 9A illustrates a state in which the binding unit 50 is the most retracted, and FIG. 9B illustrates a proceeding stage in which the binding unit 50 protrudes. The binding unit 50 protrudes to a pressing region where a binding operation is performed. Also, when the paper P enters the pressing region formed in the paper accumulating portion 70, the binding unit 50 is in the retracting state of FIG. 9A, and is retracted to a downstream side in the transporting direction where the paper P enters the pressing region.

Figure 9C:
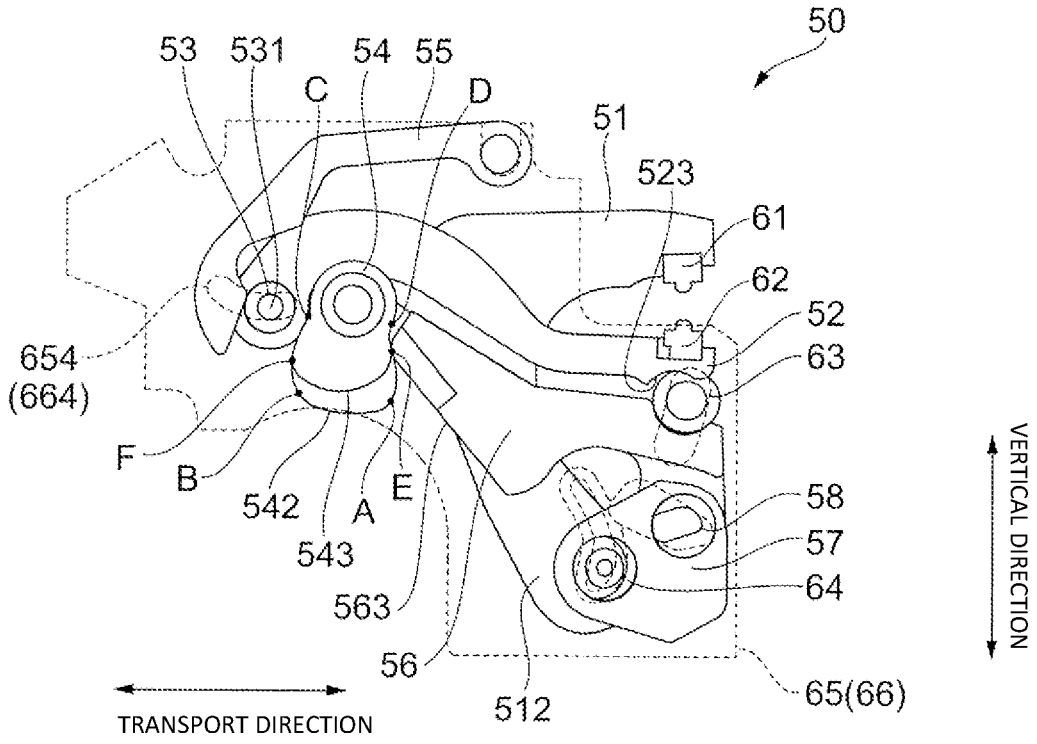
FIG. 9C is an explanatory view of a binding operation of the binding unit to which the exemplary embodiment is applied.
Figure 9D:
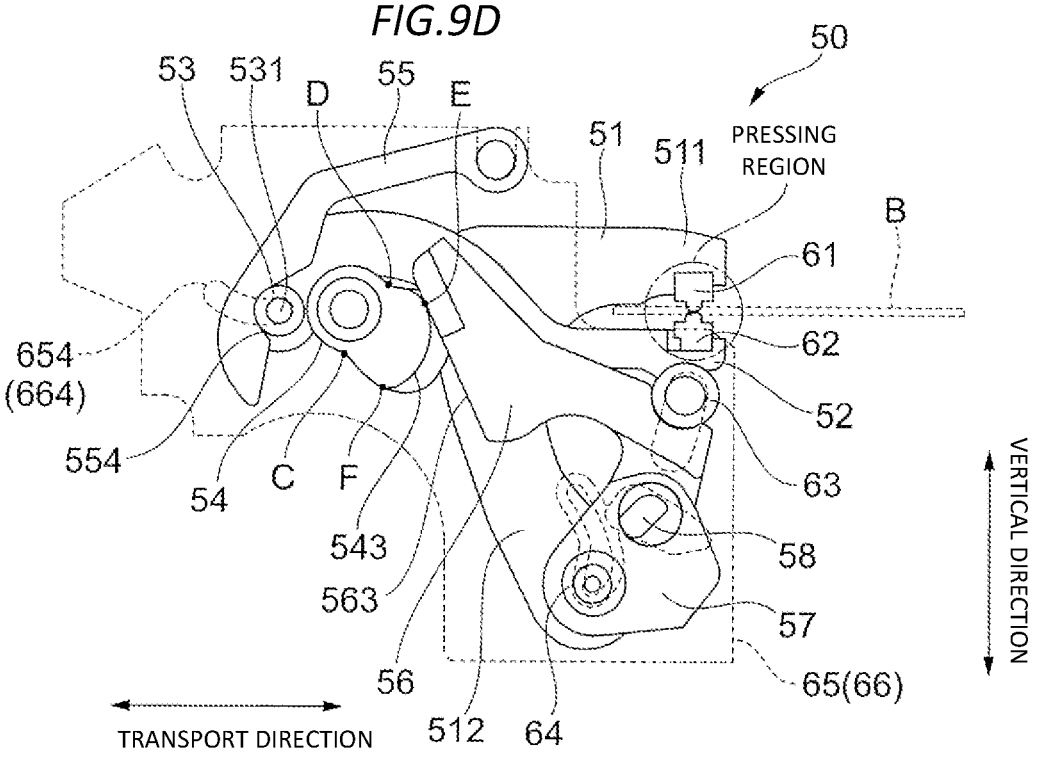
FIG. 9D is an explanatory view of the binding operation of the binding unit to which the exemplary embodiment is applied.

In addition, FIGS. 9C and 9D are explanatory views of the binding operation of the binding unit 50. FIG. 9C illustrates a state in which the upper teeth 61 and the lower teeth 62 of the binding unit 50 are close to each other in the pressing region, and FIG. 9D illustrates a start state in which the binding unit 50 starts to bind in the pressing region.

Figure 9E:
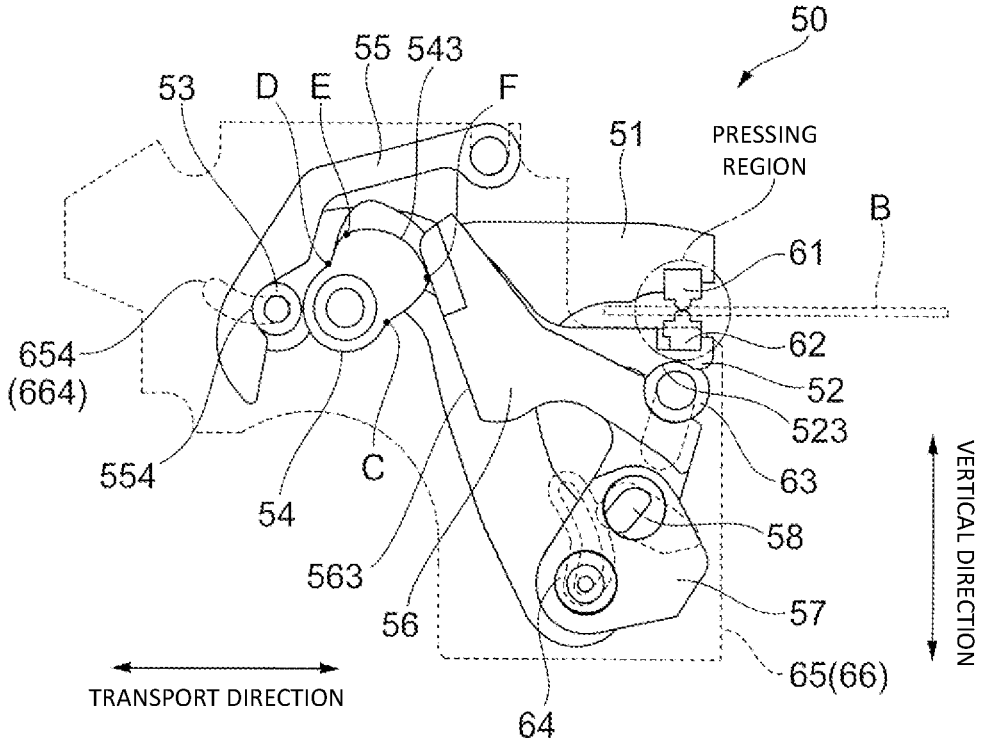
FIG. 9E is an explanatory view of the binding operation of the binding unit to which the exemplary embodiment is applied and a state in which a stopper is lifted.
Figure 9F:
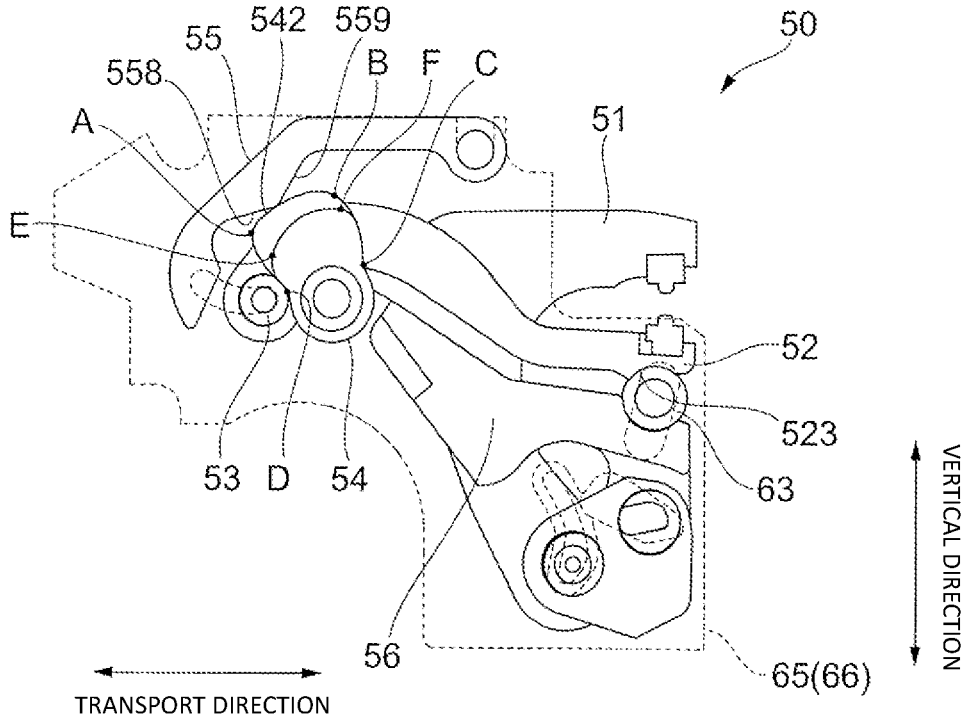
FIG. 9F is an explanatory view of the binding operation of the binding unit to which the exemplary embodiment is applied and the state in which the stopper is lifted.

In addition, FIGS. 9E and 9F are explanatory views illustrating a binding operation of the binding unit 50 and a state in which the stopper 55 is lifted. FIG. 9E illustrates a maximum state of a binding force in the binding unit 50, and FIG. 9F illustrates a state in which the recess 523 of the lower arm 52 is released from the shaft lever upper 63 by lifting the stopper 55.

The cam 54 rotates in a counterclockwise direction according to rotation of the rotating shaft 59. In FIG. 9A, the A-B surface of the cam 54 is in contact with the shaft arm 53. At this time, the small diameter portion 531 of the shaft arm 53 is pressed on one end of the arm guide 654 of the left side guide 65 and one end of the arm guide 664 of the right side guide 66 by the A-B surface of the cam 54. These one ends are positioned on a most downstream side (leftmost side of FIG. 9A) of the arm guides 654 and 664 in the transporting direction, and the shaft arm 53 is positioned on the most downstream side in the transporting direction. The upper arm 51 and the lower arm 52 are supported by the shaft arm 53 using the supporting portion 513 and the other end portion 522, but the upper arm 51 and the lower arm 52 are also in a retracting state of a most downstream position.

At this position, in the other end portion 512 of the upper arm 51, the shaft lever lower 64 is pressed by one end of the lower guide 653 of the left side guide 65 and one end of the lower guide 663 of the right side guide 66. The one ends are positioned on the most downstream side of the transporting direction of the lower guides 653 and 663, and are positioned on uppermost ends of the lower guides 653 and 663 in the vertical direction, respectively. As a result, the other end of the link 57 provided with the shaft lever lower 64 is also positioned on the most downstream side in the transporting direction, and is positioned on an uppermost position of the vertical direction. At this time, the one end of the link 57 provided with the spindle 58 is positioned on a lowermost position in the vertical direction, and the shaft lever upper 63 attached to the lever 56 is positioned on lower side of the vertical direction. At this position, the shaft lever upper 63 is not in contact with the recess 523 of the lower arm 52. In addition, the retracting slide surface 556 of the stopper 55 is pressed against the shaft arm 53 by a spring not illustrated, and the shaft arm 53 is closely attached to the cam 54.

After that, a contacting position of the cam 54 with the shaft arm 53 is changed from the A-B surface to the B-C surface of the cam 54 by the rotation of the cam 54, as illustrated in FIG. 9B. As illustrated in FIG. 9B, the shaft arm 53 moves to an upstream side of the transporting direction along the arm guides 654 and 664. The upper arm 51 and the lower arm 52 move in an upstream direction (right side of FIG. 9B) by moving the shaft arm 53. Also, a distance between the shaft lever upper 63 and the recess 523 of the lower arm 52 is reduced according to movement of the lower arm 52.

The shaft arm 53 is separated from the cam 54 and the lever 56 is in contact with the cam 54 by rotation of the cam 54, and a state proceeds from the state illustrated in FIG. 9B to the state illustrated in FIG. 9C. At this time, an action part of the cam 54 moves from the first cam crest portion 542 including the A-B surface to the second cam crest portion 543 including the E-F surface.

As illustrated in FIG. 9C, when the D-E surface of the cam 54 is in contact with a front end of the contact surface 563 of the lever 56, the lever 56 starts fluctuation toward an upper side of the vertical direction by the cam 54.

In this state, since the C-D surface of the cam 54 is not in contact with the shaft arm 53, the shaft arm 53 is released from restraint of the cam 54. A spring, which is not illustrated, always applies a force on the shaft arm 53 to the downstream side of the transporting direction via the stopper 55, and thus the shaft arm 53 moves to the upstream side of the transporting direction according to the arm guides 654 and 664. The upper arm 51 and the lower arm 52 moves to the upstream side (right side of FIG. 9C) by the movement of the shaft arm 53.

According to the movement to the upstream side of the lower arm 52, a distance between the shaft lever upper 63 and the recess 523 of the lower arm 52 is reduced, and these components are almost vertically positioned. After that, the shaft lever upper 63 is covered with the recess 523 of the lower arm 52, and the lower arm 52 receives movement to an upper side of the shaft lever upper 63 by the recess 523. Also, the lower teeth 62 attached to the lower arm 52 extrude toward the upper teeth 61 according to the movement to the upper side of the shaft lever upper 63.

After that, when the cam 54 is further rotated, as illustrated in FIG. 9D, the contact surface 563 of the lever 56 starts to come into contact with the E-F surface of the cam 54. Also, when the lever 56 is pressed by the E-F surface of the cam 54, the link 57 is pressed via the spindle 58, and the other end portion 512 of the upper arm 51 is pressed to a lower side of the vertical direction through the shaft lever lower 64. As a result, the one end portion 511 of the upper arm 51 moves, and the upper teeth 61 attached to the one end portion 511 extrude toward the lower teeth 62. FIG. 9D illustrates a start state of pressing against the paper bundle B by the upper teeth 61 and the lower teeth 62.

Also, the shaft arm 53 is pressed to the most upstream positions of the arm guides 654 and 664 in the transporting direction by receiving a force from the stopper 55. Also, the upper arm 51 and the lower arm 52 respectively attached to the shaft arm 53 protrude to the most upstream side (right side of FIG. 9D) of the transporting direction.

After that, the cam 54 is further rotated, and the contact surface 563 of the lever 56 is further pressed by the E-F surface of the cam 54. As a result, the link 57 is further strongly pressed via the spindle 58, and the other end portion 512 of the upper arm 51 is further strongly pressed to a lower side of the vertical direction via the shaft lever lower 64. Also, as illustrated in FIG. 9E, when the contact surface 563 of the lever 56 comes into contact with an F point of the cam 54, the pressing force to the paper bundle B becomes the maximum by the upper teeth 61 and the lower teeth 62. By a proceeding state from FIG. 9D to FIG. 9E, between one end portion 511 and the other end portion 512 of the upper arm 51 bent in V shape (or U shape), the lever 56 and the link 57 extends upward like the jack structure, and the strong pressing force to the paper bundle B due to the upper teeth 61 and the lower teeth 62 receives by the "flexibility" of a member of the upper arm 51. Accordingly, for example, approximately 1 t of the pressing force is applied to the paper bundle B.

After the binding operation with respect to the paper bundle B is finished in this way, when the cam 54 is further rotated, an F-C surface of the cam 54 is in contact with the contact surface 563 of the lever 56, pressing against of the upper teeth 61 and the lower teeth 62 is gradually released. After that, when the cam 54 continues to rotate, as illustrated in FIG. 9F, the stopper 55 is lifted by the A-B surface of the cam 54, and the shaft arm 53 is allowed to move to the downstream side in the transporting direction. Also, the shaft arm 53 moves to the downstream side in the transporting direction along a D-A surface of the cam 54. The upper arm 51 and the lower arm 52 respectively connected to the shaft arm 53 retract to the downstream side in the transporting direction by the movement of the shaft arm 53. Also, the upper arm and the lower arm is in the retracting state of FIG. 9A, the paper bundle B (paper P) is collected and is standby until the binding operation starts. At this time, according to an operation for making the distance increased where the one end portion 511 including the upper teeth 61 which is the first pressing portion faces the one end portion 521 of the lower arm 52 which is the second pressing portion, retraction is performed on the downstream side than the pressing region.

In this way, the one end portion 521 of the lower arm 52 which functions as the second pressing portion extrudes toward the one end portion 511 of the upper arm 51 which functions as the first pressing portion by the shaft lever upper 63 which is an action point, at the time of protruding to the pressing region or after protruded.

Also, in the exemplary embodiment described above, a retracting operation in which the binding unit 50 retracts to the downstream side thereof when the paper P enters to the paper accumulating portion 70 will be described. However, the retracting operation is performed, even when the binding unit 50 moves in order to change a binding position. More specifically, after the paper bundle B is collected in the paper accumulating portion 70 which is a collecting portion, in a state in which at least any one of the first pressing portion and the second pressing portion is retracted from the pressing region, a position with respect to the paper accumulating portion 70 is changed.

In addition, since the motor 691 which is a driving source of the binding unit 50 is fixed to the frame of the right side guide 66 and/or the right side frame 68 as described above, retracting and advancing (moving in transporting direction) are not performed with the pressing portion (upper arm 51 and lower arm 52).

In addition, the extrusion link structure (extruding portion) in the binding unit 50 is formed of a different member from the second pressing portion, and the second pressing portion extrudes toward the first pressing portion. The second pressing portion is supported to be movable relatively to the extrusion link structure, and presses against the paper bundle B by being extruding using the extrusion link structure. Also, the second pressing portion presses against the paper bundle B extruding in an extrusion direction by the extrusion link structure on the pressing region, moves and retracts in a direction intersecting the extrusion direction by an operation different from the extrusion link structure, and moves to the pressing region by moving in the direction intersecting the extrusion direction by the operation different from the extrusion link structure at the time of pressing against.

Next, the extrusion link structure (extruding portion) to which the exemplary embodiment is applied will be further described in detail with reference to FIGS. 10A to 10D.

Figure 10A:
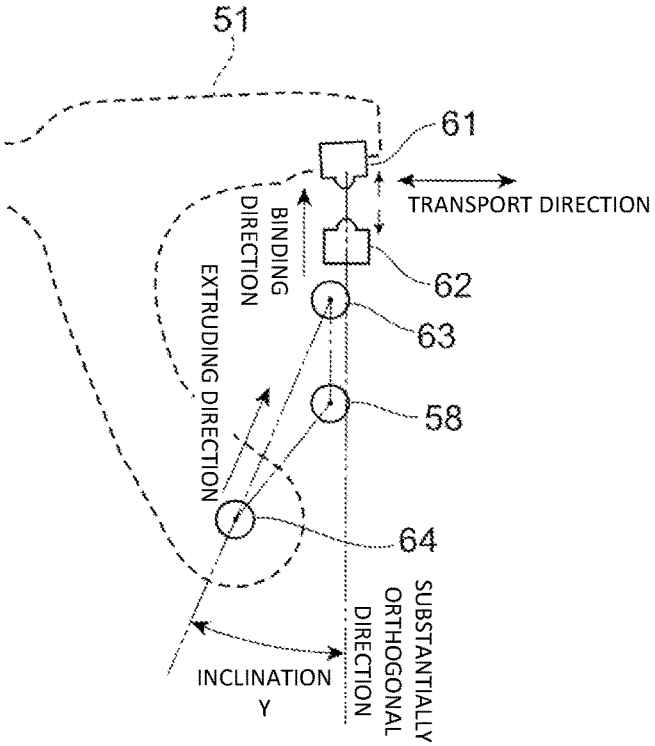
FIG. 10A is an explanatory view of an extrusion link structure.
Figure 10B:
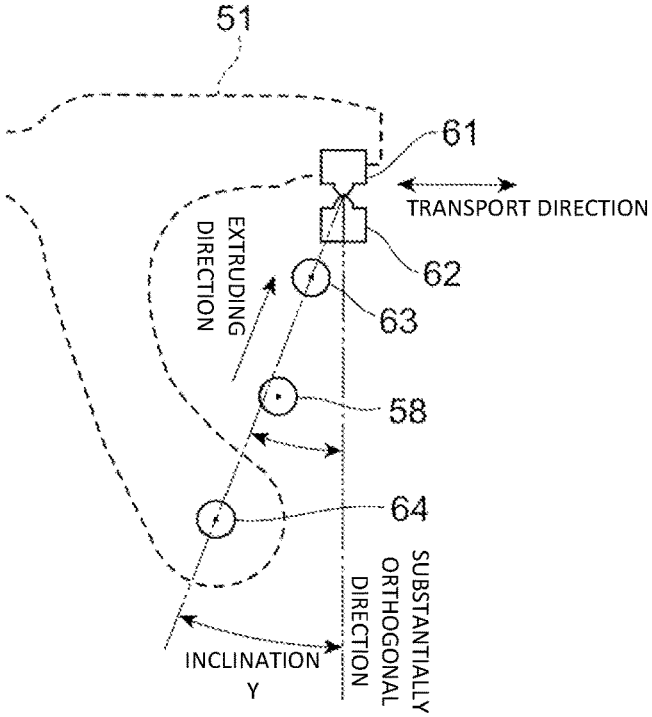
FIG. 10B is an explanatory view of the extrusion link structure.
Figure 10C:
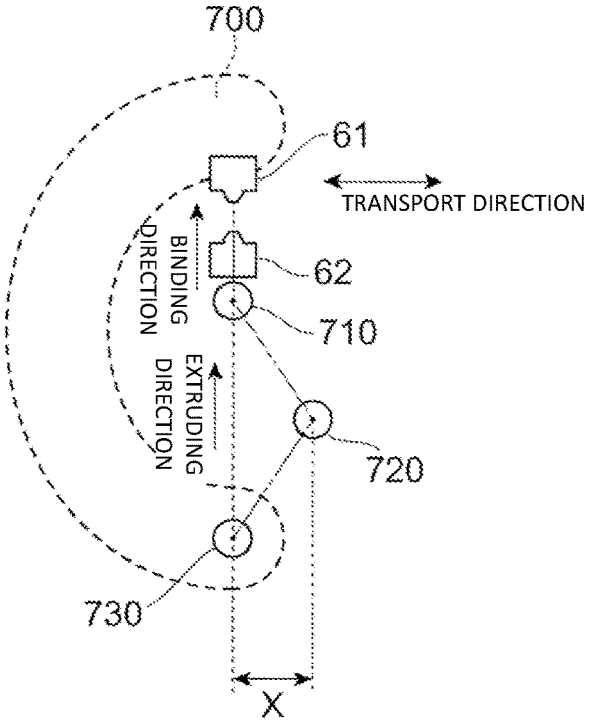
FIG. 10C is an explanatory view of the extrusion link structure.
Figure 10D:
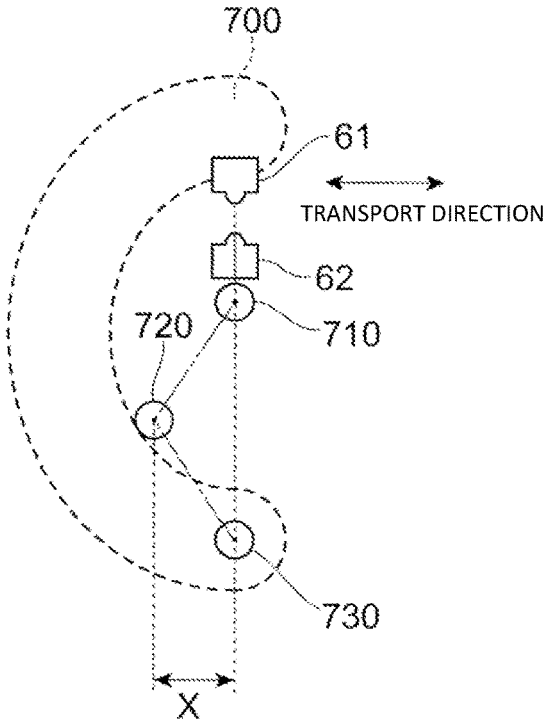
FIG. 10D is an explanatory view of the extrusion link structure.

FIGS. 10A to 10D are explanatory views of the extrusion link structure. FIGS. 10A and 10B illustrate the extrusion link structure to which the exemplary embodiment is applied, and FIGS. 10C and 10D illustrates a case in which an extrusion link structure to which the exemplary embodiment is not applied is used.

For example, in a binding device which performs binding without a needle, in order to obtain a great binding force, a jack structure using a link which causes a distance between a starting point and the action point of the extrusion to be changed is adopted. Also, an extrusion direction with the jack structure using the link is generally the same as a binding direction where binding is performed as illustrated in FIGS. 10C and 10D. For example, if the transporting direction of the paper bundle B or the paper P is a horizontal direction, the binding direction is a substantially vertical direction which is a direction substantially orthogonal to the transporting direction, but the extrusion direction (a direction of a segment connecting starting point 730 and action point 710) with the jack structure is also generally a substantially vertical direction which is a direction substantially orthogonal to the transporting direction.

However, as illustrated in FIGS. 10C and 10D, if the binding direction and the extrusion direction are coincide with each other, in a state (standby state) in which the jack structure is contracted by the link, the connecting portion 720 of the link widens transversely in a direction orthogonal to the extrusion direction. The connecting portion 720 protrudes as X dimension to the outside of the apparatus in a case of FIG. 10C, and protrudes as X dimension to the inside of the apparatus in a case of FIG. 10D. The apparatus increases in size as X dimension in the case of FIG. 10C, and is interfered with a structure 700 by the X dimension in the case of FIG. 10D.

Meanwhile, in the exemplary embodiment, as illustrated in FIGS. 10A and 10B, the extrusion direction is inclined with respect to a direction (substantially orthogonal direction and substantially vertical direction) substantially orthogonal to the transporting direction of the paper bundle B or the paper P. That is, with the jack structure using the link changing the distance between the starting point to the action point, where the shaft lever upper 63 which is the action point, the shaft lever lower 64 which is the starting point portion, and the spindle 58 which is the connecting portion are used, the extrusion direction (a direction of a segment connecting the shaft lever lower 64 and the shaft lever upper 63) is inclined as Y inclination toward the inside of the apparatus (a left side of the drawing, a direction where the paper bundle B enters the pressing region in the transporting direction, and the downstream side of the transporting direction) with respect to the binding direction by the upper teeth 61 and the lower teeth 62. As a result, at the time of the standby before binding is performed illustrated in FIG. 10A, even when the link is in a contracted state, the connecting portion (spindle 58) which is the most protruding part is not greatly fallen out from the apparatus.

Also, the shaft lever upper 63 which is the action point, the shaft lever lower 64 which is the starting point portion, and the tooth tip of the teeth where the upper teeth 61 and the lower teeth 62 are engaged are nearly positioned on a straight line, and thus the center of a tip end of the teeth type easily collects a force.

In addition, as described above with reference to FIGS. 5B and 5C, the upper teeth 61 and the lower teeth 62 to which the exemplary embodiment is applied are the teeth type of the teeth of a part where the needleless binding is performed, a cross-section of the teeth is a trapezoidal shape in the transporting direction of the paper, the width D2 of the tooth tip is narrower than the width D1 of the tooth root, and the tooth tip tapers.

As described above, in the exemplary embodiment, in the jack structure by the link, the extrusion direction is inclined; however, if the extrusion direction is inclined, a moment acts, and the teeth do not straightly match each other. That is, since a rotation force acts, a posture of the teeth is difficult to be balanced. If the teeth are straightly pressed as illustrated in FIG. 10C and FIG. 10D, the teeth do not rotate; however, if the rotating center is deviated to a side in the case of obliquely pressing, the teeth rotate.

Here, in the exemplary embodiment, in the upper teeth 61 and the lower teeth 62, a cross-section of the teeth in the transporting direction of the paper is set to a trapezoidal shape, and, the width D2 of the tooth tip is made narrower than the width D1 of the root of tooth, whereby the teeth are configured so that the contact of the teeth to the paper bundle B approximates to point contact from line contact, and to line contact from surface contact. Therefore, even when a load is obliquely applied, the teeth are easily balanced, for example, it is possible to suppress the teeth (upper teeth 61 or lower teeth 62) being unbalanced and turned over or the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A binding device comprising:

a pressing portion that binds a bundle of recording materials and includes a first arm including a first pressing portion at one end of the first arm, the first pressing portion pressing against the bundle of the recording materials and a second arm including a second pressing portion at one end of the second arm, the second pressing portion facing the first pressing portion and pressing against the bundle of the recording materials;

an extruding portion that is connected to the pressing portion and extrudes the second pressing portion toward the first pressing portion; and a driving source that drives the extruding portion, wherein the first arm and the second arm retract to a downstream side in a transport direction of the recording materials when the recording material is transported to a position where the second pressing portion is configured to face the first pressing portion, wherein the driving source does not retract in conjunction with the retraction of the pressing portion, and wherein the extruding portion has a jack structure including a link that changes a distance between a starting point portion that serves as a starting point of extruding and is connected on an other end side of the member of the pressing portion and an action point portion that acts on the second pressing portion.

2. The binding device according to claim 1, further comprising:

a frame to which the driving source is fixed.

3. The binding device according to claim 2, further comprising:

a transmission unit that transmits a driving force from the driving source fixed to the frame, wherein the extruding portion further comprises a configuration member that causes an extrusion force to the second pressing portion, and the transmission unit directly transmits the driving force to the configuration member.

4. The binding device according to claim 1, wherein the extruding portion extrudes the second pressing portion toward the first pressing portion, and wherein the pressing portion comprises a member that includes the first pressing member at one end side and that is connected to the extruding portion on the other end side.

5. The binding device according to claim 1, wherein an other end of the first arm and an other end of the second arm are connected by a shaft.

6. The binding device according to claim 5, further comprising at least one guide member that guides the shaft in the transport direction of the recording materials.

* * * * *